US010985510B2

(12) United States Patent
Saito et al.

(10) Patent No.: US 10,985,510 B2
(45) Date of Patent: Apr. 20, 2021

(54) CONNECTOR WITH A SEALING MEMBER

(71) Applicant: YAZAKI CORPORATION, Tokyo (JP)

(72) Inventors: Akihiro Saito, Kakegawa (JP); Kai Kiuchi, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/726,209

(22) Filed: Dec. 23, 2019

(65) Prior Publication Data

US 2020/0212637 A1 Jul. 2, 2020

(30) Foreign Application Priority Data

Dec. 28, 2018 (JP) ..... JP2018-247806

(51) Int. Cl.
*H01R 13/74* (2006.01)
*H01R 13/52* (2006.01)
*H01R 4/18* (2006.01)

(52) U.S. Cl.
CPC ..... *H01R 13/74* (2013.01); *H01R 13/5202* (2013.01); *H01R 4/18* (2013.01)

(58) Field of Classification Search
CPC .... H01R 13/74; H01R 13/52; H01R 13/5202; H01R 13/5208; H01R 13/521; H01R 13/5219; H01R 4/18
See application file for complete search history.

(56) References Cited

U.S. PATENT DOCUMENTS 5,709,563 A * 1/1998 Saito ..... H01R 13/5208 439/275
8,992,242 B2 * 3/2015 Casses ..... H01R 13/5219 439/271
10,361,503 B2 * 7/2019 Motohashi ..... H01R 13/5208
2004/0106325 A1 6/2004 Miyazaki
2015/0207263 A1 * 7/2015 Fabre ..... H01R 13/506 439/271
2019/0372266 A1 * 12/2019 Kodama ..... H01R 13/50

FOREIGN PATENT DOCUMENTS

JP 2004-172009 A 6/2004

* cited by examiner

*Primary Examiner* — Oscar C Jimenez
(74) *Attorney, Agent, or Firm* — Kenealy Vaidya LLP

(57) ABSTRACT

A connector includes a housing having a fitting portion fitted into a mounting hole, a conductor held by the housing, and a sealing member mounted on the fitting portion and sealing between the housing and the mounting hole. The sealing member includes an annular sealing portion formed in an annular shape fitted into the fitting portion, and a band portion connected to the annular sealing portion at both ends and disposed along an end surface of the fitting portion.

4 Claims, 8 Drawing Sheets

CONNECTOR WITH A SEALING MEMBER

CROSS REFERENCE TO RELATED APPLICATIONS

This application claims priority from Japanese Patent Application No. 2018-247806 filed on Dec. 28, 2018, the entire contents of which are incorporated herein by reference.

BACKGROUND OF THE INVENTION

Field of the Invention

The present invention relates to a connector.

Description of Related Art

A connector where a housing is fitted and mounted to a mounting hole formed in a case of a device is known, in which waterproofing was done between an outer circumference of the housing and an inner circumference of the mounting hole by a ring-shaped sealing member (for example, Patent Literature 1: JP-A-2004-172009).

In the connector, a locking portion of the sealing member is engaged with the regulating portion provided in the housing, so that ranging of the sealing member with respect to the housing in the circumferential direction is regulated and positioned.

Patent Literature 1: JP-A-2004-172009

In the connector that fits the housing into the mounting hole, in particular, when an excessive load is applied during fitting into the mounting hole, the sealing member in sliding contact with the inner circumferential surface of the mounting hole may be dragged inside out, and required sealing performance may not be obtained.

SUMMARY

One or more embodiments provide a connector capable of reliably exhibiting sealing performance with an inner circumferential surface of a mounting hole by a sealing member.

In order to achieve the above object, the connector according to one or more embodiments is characterized by the following (1) to (4).

(1) A connector includes a housing having a fitting portion fitted into a mounting hole, a conductor held by the housing, and a sealing member mounted on the fitting portion and sealing between the housing and the mounting hole. The sealing member includes an annular sealing portion formed in an annular shape fitted into the fitting portion, and a band portion connected to the annular sealing portion at both ends and disposed along an end surface of the fitting portion.

(2) A plurality of the conductors are held in parallel by the housing. The band portion is disposed between the conductors on the end surface of the fitting portion.

(3) A holding groove into which the band portion is fitted is formed on the end surface of the fitting portion.

(4) A mounting groove into which the annular sealing portion is fitted is formed on a circumferential surface of the fitting portion over a circumferential direction. A notch portion holding an end portion of the band portion is formed between the holding groove and the mounting groove.

According to the connector having the configuration of the above (1), the sealing member equipped to the fitting portion of the housing has the annular sealing portion fitted into the fitting portion, and the band portion which is connected to the annular sealing portion at both ends and is disposed along the end surface of the fitting portion.

Therefore, even though the annular sealing portion adheres closely to and is in sliding contact with the inner circumferential surface of the mounting hole by fitting the fitting portion in the mounting hole and frictional force acts on the annular sealing portion toward the rear side in the direction of fitting into the mounting hole, turning inside out is prevented by the band portion.

Accordingly, sealing performance of the annular sealing portion of the sealing member with the inner circumferential surface of the mounting hole can be reliably exhibited, and permeation of water, oil, dust, or the like between the mounting hole and the housing can be reliably prevented.

In addition, as compared with a structure in which the sealing member is held by using a holder or the like of another component, it is possible to prevent turning inside out during fitting into the mounting hole without increasing the cost.

According to the connector having the configuration of the above (2), since the band portion is disposed between the conductors on the end surface of the fitting portion, it is possible to prevent turning inside out of the annular sealing portion in good balance by the band portion.

According to the connector having the configuration of the above (3), by fitting the band portion into the holding groove formed on the end surface of the fitting portion, the sealing member can be positioned in the circumferential direction of the fitting portion of the housing, and rotation can be stopped.

According to the connector having the configuration of the above (4), by fitting the annular sealing portion into the mounting groove of the fitting portion, the annular sealing portion is held on the fitting portion well. In addition, the band portion is fitted into the holding groove to be held well, and the ends connected to the annular sealing portion are held on the notch portion. Accordingly, the entire sealing member can be held well on the fitting portion of the housing.

According to one or more embodiments, it is possible to provide a connector capable of reliably exhibiting the sealing performance with the inner circumferential surface of the mounting hole by the sealing member.

The present invention has been briefly described above. Further, details of the present invention will be further clarified by reading modes for carrying out the present invention to be described below (hereinafter, referred to as "embodiments") with reference to the accompanying drawings.

BRIEF DESCRIPTION OF THE DRAWINGS

FIG. 3A is a front view of the housing. FIG. 3B is a side view of the housing.

FIG. 4A is a front view of the sealing member. FIG. 4B is a side view of the sealing member.

FIG. 5A and FIG. 5B each are cross-sectional views of the panel and the connector.

DETAILED DESCRIPTION

Hereinafter, embodiments according to the present invention will be described with reference to the drawings.

Figure 1:
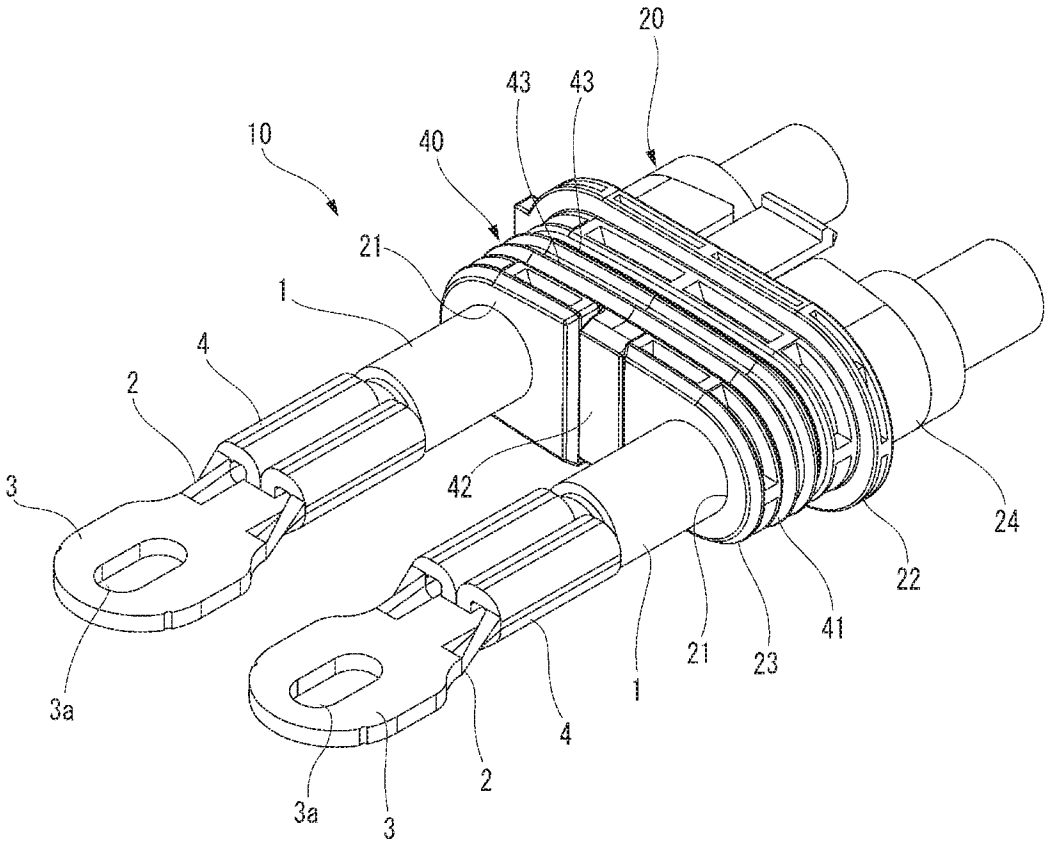
FIG. 1 is a perspective view of a connector according to the present embodiment.
Figure 2:
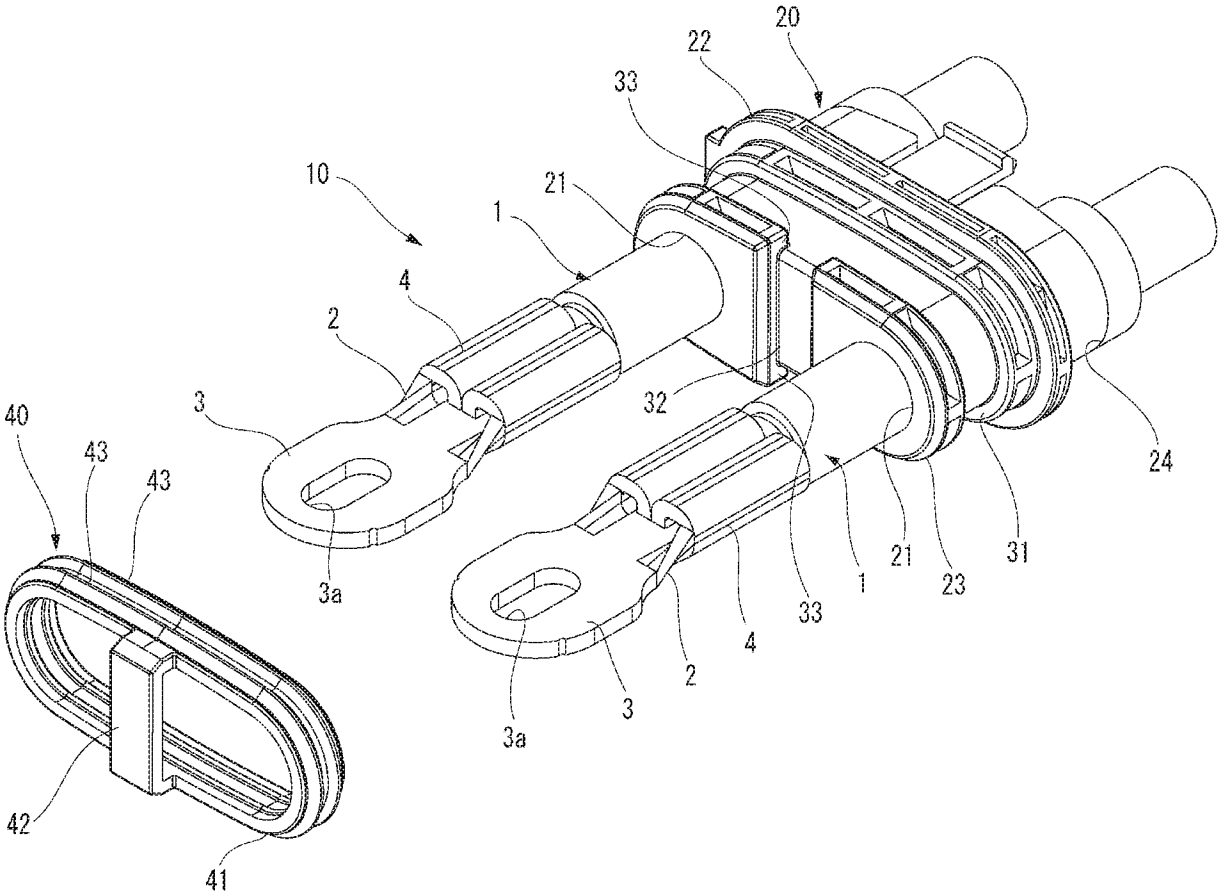
FIG. 2 is a perspective view of a sealing member and a housing constituting the connector according to the present embodiment.

FIG. 1 is a perspective view of a connector according to the present embodiment. FIG. 2 is a perspective view of a sealing member and a housing constituting the connector according to the present embodiment.

As shown in FIG. 1 and FIG. 2, a connector 10 according to the present embodiment includes a housing 20 and a sealing member 40. Two electric wires (conductors) 1 are held in the connector 10, and terminal fittings 2 formed of a conductive metal material are connected to ends of the electric wires 1. The terminal fitting 2 includes a connection plate portion 3 having a connection hole 3*a* and a crimp connection portion 4. The crimp connection portion 4 is crimped and electrically connected to a core wire exposed from a sheath at an end portion of the electric wire 1.

Figure 3B:
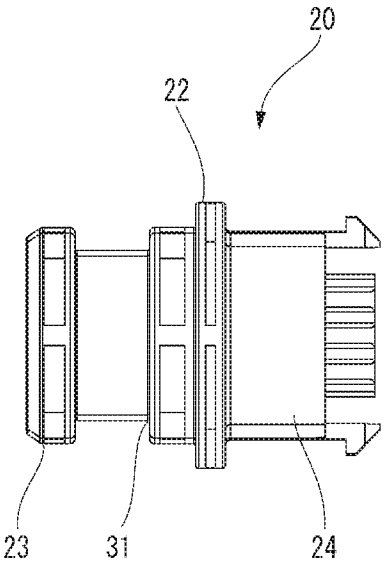
FIGS. 3A and 3B show the housing.
Figure 3A:
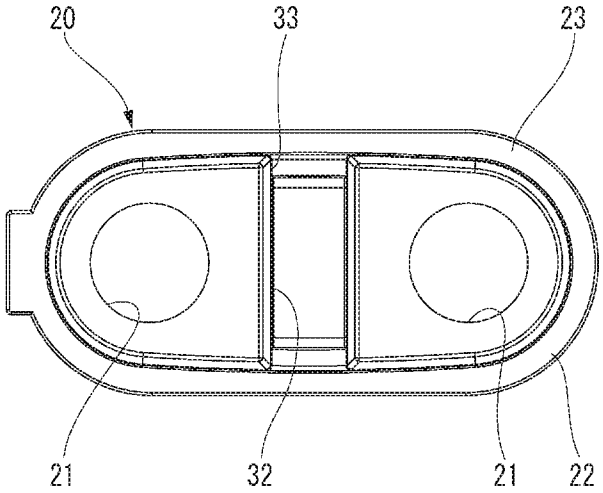

FIGS. 3A and 3B show the housing. FIG. 3A is a front view of the housing. FIG. 3B is a side view of the housing.

As shown in FIGS. 3A and 3B, the housing 20 is formed in an oval shape in the front view, and has an electric wire insertion hole 21 penetrating the housing 20 in a front-rear direction. The housing 20 is formed of a synthetic resin, and therefore has a flange portion 22 projecting outward over a circumferential direction at a middle portion in the front-rear direction.

With the flange portion 22 as a boundary, a front side of the housing 20 is a fitting portion 23, and a rear side of the housing 20 is an electric wire lead-out portion 24. The electric wire 1 is passed through the wire insertion hole 21 in the housing 20, and a vicinity of the end of the electric wire 1 is fixed to the housing 20. An end of the electric wire 1 to which the terminal fitting 2 is connected projects from the fitting portion 23, and a rear end side is drawn out from the wire lead-out portion 24. The fitting portion 23 is fitted and fixed to a mounting hole formed in a panel of various devices which is a connection place of the connector 10. Accordingly, the terminal fitting 2 connected to the end of the electric wire 1 is disposed in various devices, and the connection plate portion 3 of the terminal fitting 2 is connected to terminal block and mating side terminal fittings in the device.

The fitting portion 23 of the housing 20 has a mounting groove 31 and a holding groove 32. The mounting groove 31 is formed on an outer circumferential surface of the fitting portion 23 over the circumferential direction. The holding groove 32 is formed on an end surface of the fitting portion 23. The holding groove 32 is formed between the wire insertion holes 21 on the end surface of the fitting portion 23. Further, a notch portion 33 communicating with the mounting groove 31 and the holding groove 32 is formed between the mounting groove 31 and the holding groove 32.

Figure 4B:
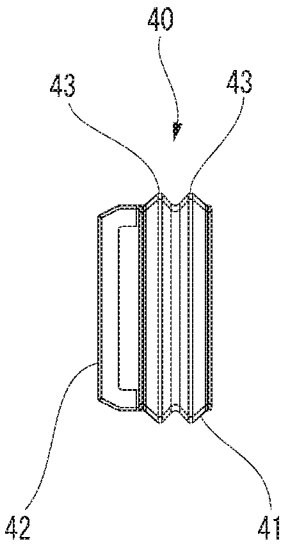
FIGS. 4A and 4B show the sealing member.
Figure 4A:
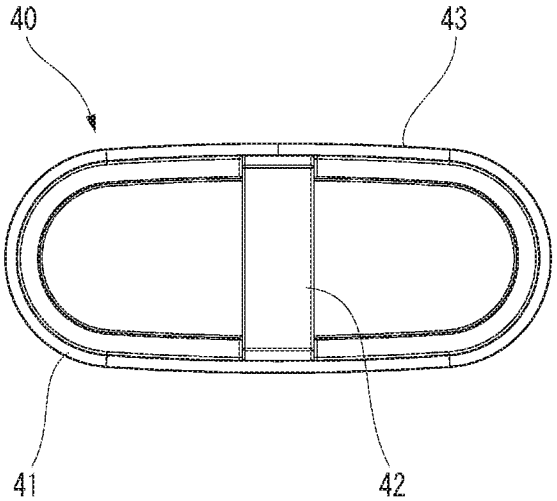

FIGS. 4A and 4B show the sealing member. FIG. 4A is a front view of the sealing member. FIG. 4B is a side view of the sealing member.

As shown in FIGS. 4A and 4B, the sealing member 40 includes an annular sealing portion 41 and a band portion 42. The sealing member 40 is formed of an elastic material such as rubber and silicon. Similarly to the housing 20, the annular sealing portion 41 is formed in an oval shape in the front view, and two lip portions 43 projecting outward in a mountain form are formed over the circumferential direction on the outer circumference of the annular sealing portion 41. The annular sealing portion 41 has an inner shape slightly smaller than an outer shape of the fitting portion 23 of the housing 20 on a cross section of the mounting groove 31. The band portion 42 is formed in a band shape, and both ends thereof are connected to a front edge portion of the annular sealing portion 41 and are bridged along a minor axis of the oval.

The sealing member 40 is equipped from a front side of the fitting portion 23 of the housing 20. When the sealing member 40 is equipped, the fitting portion 23 of the housing 20 enters the widened annular sealing portion 41. Then, the annular sealing portion 41 is fitted into the mounting groove 31 of the fitting portion 23, and the band portion 42 is fitted into the holding groove 32 of the fitting portion 23.

As described above, when the sealing member 40 is equipped to the fitting portion 23 of the housing 20, in the seal member 40, the lip portions 43 of the annular sealing portion 41 fitted in the mounting groove 31 project toward the outer circumference of the fitting portion 23.

Next, a case in which the connector 10 including the sealing member 40 is equipped on a panel of a device will be described.

Figure 5A:
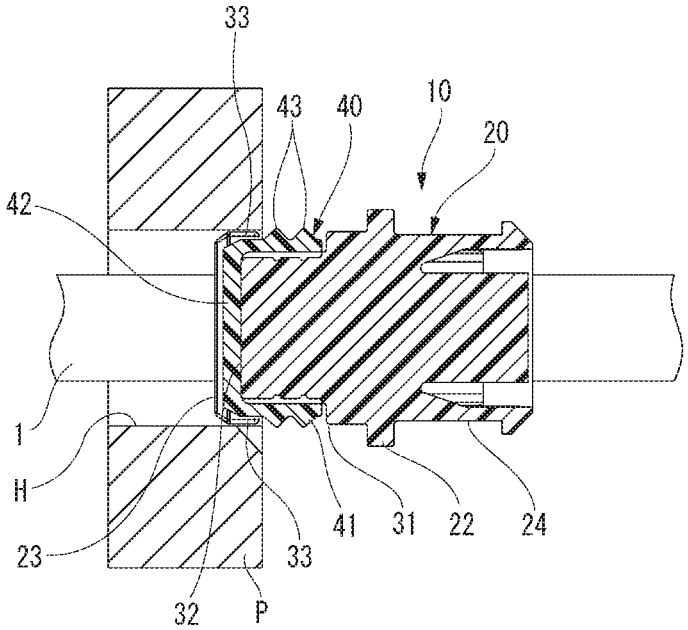
FIGS. 5A and 5B illustrate a process of equipping the connector to a panel.
Figure 5B:
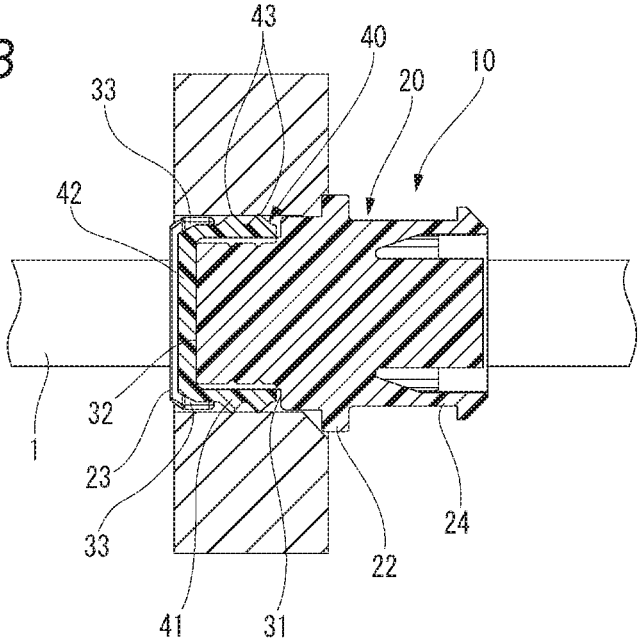

FIGS. 5A and 5B illustrate a process of equipping the connector to a panel. FIG. 5A and FIG. 5B each are cross-sectional views of the panel and the connector.

As shown in FIG. 5A, in order to equip the connector 10 to a panel P of a device, the terminal fitting 2 is inserted into a mounting hole H formed in the panel P, and the fitting portion 23 of the housing 20 is fitted in until the flange portion 22 abuts. The mounting hole H has an inner shape slightly larger than the outer shape of the fitting portion 23.

As shown in FIG. 5B, when the fitting portion 23 of the housing 20 is fitted into the mounting hole H of the panel P, the lip portion 43 of the annular sealing portion 41 of the sealing member 40 equipped to the fitting portion 23 adheres closely to an inner circumferential surface of the mounting hole H. Since the fitting portion 23 is fitted into the mounting hole H, the annular sealing portion 41 of the sealing member 40 where the lip portion 43 adheres closely to the inner circumferential surface of the mounting hole H seals a space between the mounting hole H and the fitting portion 23.

As described above, when the fitting portion 23 is fitted into the mounting hole H, the lip portion 43 is in sliding contact with the inner circumferential surface of the mounting hole H, so that frictional force toward a rear side in the fitting direction acts on the outer circumferential side of the annular sealing portion 41 of the sealing member 40. At this time, turning inside out of the annular sealing portion 41 is prevented by the band portion 42 fitted into the holding groove 32 of the fitting portion 23.

Here, a connector according to a reference example will be described.

Figure 6:
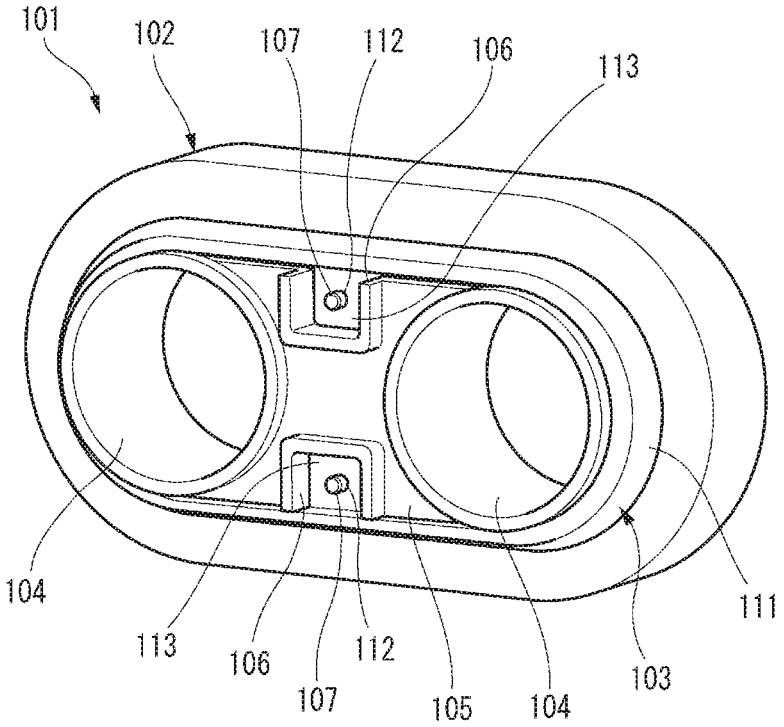
FIG. 6 is a perspective view of the connector according to a reference example.

FIG. 6 is a perspective view of the connector according to a reference example.

As shown in FIG. 6, in a connector 101 according to the reference example, an annular sealing portion 111 formed in an annular shape of a sealing member 103 is equipped to a fitting portion 105 in which a pair of electric wire insertion holes 104 of the housing 102 is formed. The sealing member 103 has locking piece portions 113 in which hole portions 112 are formed at positions facing each other in the annular sealing portion 111. The fitting portion 105 of the housing 102 has a pair of locking recesses 106 on end surfaces thereof, and locking pins 107 projecting forward from the end surfaces of the fitting portion 105 are formed in the locking recesses 106.

In the connector 101, the annular sealing portion 111 is fitted into the fitting portion 105, the locking piece portion 113 is fitted in the locking recess 106, and the locking pin 107 is inserted into the hole portion 112. Accordingly, the sealing member 103 is equipped to the housing 102.

In this reference example, when the fitting portion 105 is fitted in the mounting hole H, the annular sealing portion 111 of the sealing member 103 equipped to the fitting portion 105 is in sliding contact with the inner circumferential surface of the mounting hole H, so that the annular sealing portion 111 is dragged by the frictional force received from the inner circumferential surface of the mounting hole H. When the frictional force received from the inner circumferential surface of the mounting hole H is large, the locking piece portion 113 is pulled by the dragged annular sealing portion 111, and the locking pin 107 may be slipped out from the hole portion 112. Then, the annular sealing portion 111 locked on the fitting portion 105 returns inside out by the locking piece portion 113, and sealing of the sealing member 103 with the mounting holes H may be insufficient.

In contrast, in the connector 10 according to the present embodiment, the sealing member 40 equipped to the fitting portion 23 of the housing 20 has the annular sealing portion 41 fitted into the fitting portion 23, and the band portion 42 which is connected to the annular sealing portion 41 at both ends and is disposed along the end surface of the fitting portion 23.

Therefore, even though the annular sealing portion 41 adheres closely to and is in sliding contact with the inner circumferential surface of the mounting hole H by fitting the fitting portion 23 in the mounting hole H and frictional force acts on the annular sealing portion 41 toward the rear side in the direction of fitting into the mounting hole H, turning inside out is prevented by the band portion 42.

Accordingly, sealing performance of the annular sealing portion 41 of the sealing member 40 with the inner circumferential surface of the mounting hole H can be reliably exhibited, and permeation of water, oil, dust, or the like between the mounting hole H and the housing 20 can be reliably prevented.

In addition, as compared with a structure in which the sealing member 40 is held by using a holder or the like of another component, it is possible to prevent turning inside out during fitting into the mounting hole without increasing the cost.

Moreover, since the band portion 42 is disposed between the electric wires 1 on the end surface of the fitting portion 23, it is possible to prevent turning inside out of the annular sealing portion 41 in good balance by the band portion 42.

In addition, by fitting the band portion 42 into the holding groove 32 formed on the end surface of the fitting portion 23, the sealing member 40 can be positioned in the circumferential direction of the fitting portion 23 of the housing 20, and rotation can be stopped.

Further, by fitting the annular sealing portion 41 into the mounting groove 31 of the fitting portion 23, the annular sealing portion 41 is held on the fitting portion 23 well. In addition, the band portion 42 is fitted into the holding groove 32 to be held well, and the ends connected to the annular sealing portion 41 are held on the notch portion 33. Accordingly, the entire sealing member 40 can be held well on the fitting portion 23 of the housing 20.

Here, a connector according to a modification will be described.

(First Modification)

Figure 7:
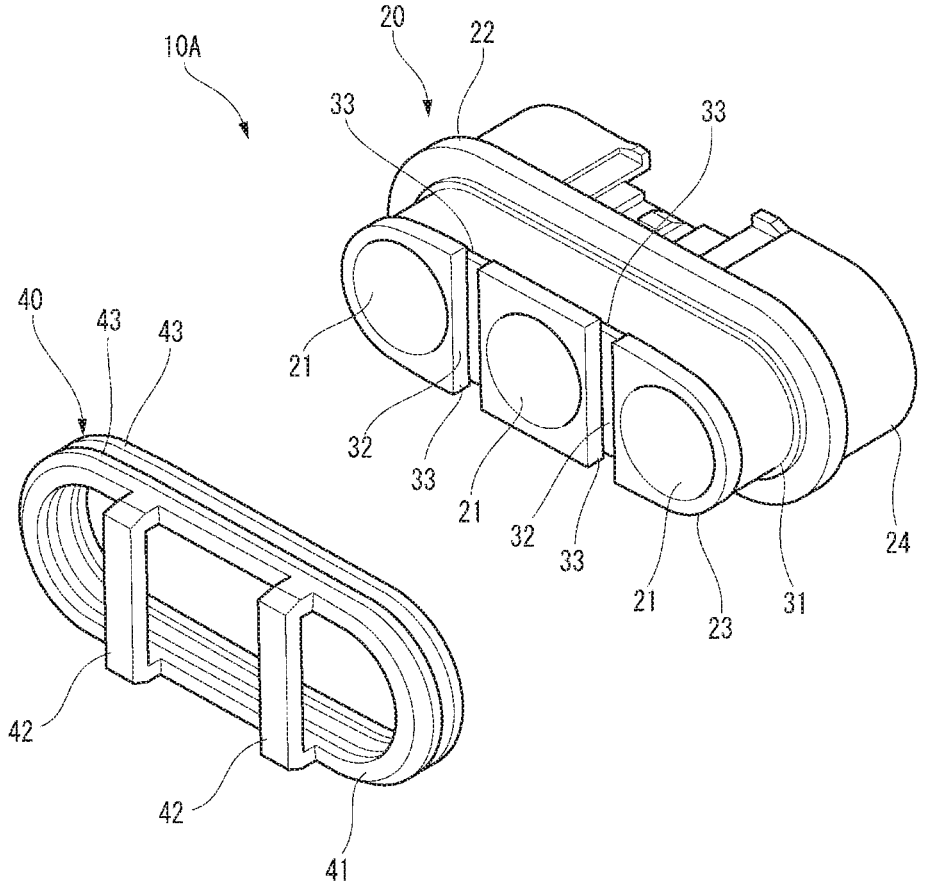
FIG. 7 is a perspective view of a sealing member and a housing that illustrate a connector according to a first modification.

FIG. 7 is a perspective view of a sealing member and a housing that illustrate a connector according to a first modification.

As shown in FIG. 7, in a connector 10A according to the first modification, three electric wire insertion holes 21 through which the electric wires 1 are inserted are formed in the housing 20. The electric wire insertion holes 21 are disposed in a column at intervals from each other. In the housing 20, the holding grooves 32 are formed between the electric wire insertion holes 21 on an end surface of the fitting portion 23. Further, the notch portions 33 are formed at the ends of the holding grooves 32 respectively, so that each holding groove 32 communicates with the mounting groove 31 formed over the circumferential direction on the outer circumferential surface of the fitting portion 23.

In the connector 10A according to the first modification, two band portions 42 are formed on the sealing member 40. The band portions 42 are disposed at intervals from each other. When the sealing member 40 is equipped to the fitting portion 23 of the housing 20, each band portion 42 is fitted in the holding groove 32 formed between the wire insertion holes 21.

According to the connector 10A according to the first modification, even though frictional force acts on the annular sealing portion 41 toward the rear side in the direction of fitting into the mounting hole H, turning inside out is prevented by the two band portions 42 in good balance. Therefore, sealing performance of the annular sealing portion 41 of the sealing member 40 with the inner circumferential surface of the mounting hole H can be reliably exhibited, and permeation of water, oil, dust, or the like between the mounting hole H and the housing 20 can be reliably prevented.

(Second Modification)

Figure 8:
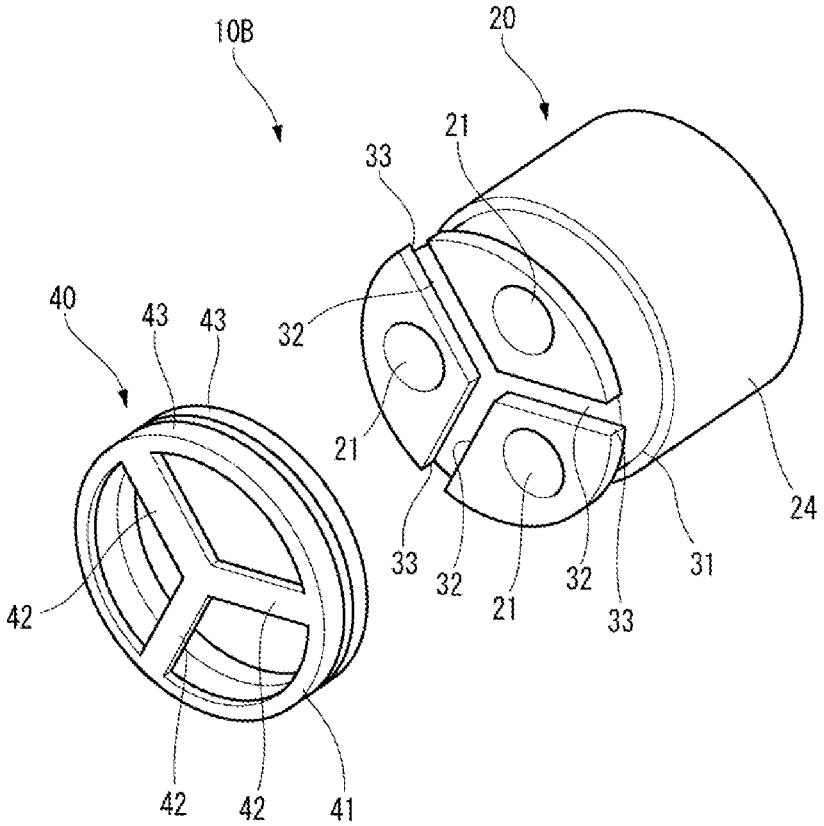
FIG. 8 is a perspective view of a sealing member and a housing that illustrate a connector according to a second modification.

FIG. 8 is a perspective view of a sealing member and a housing that illustrate a connector according to a second modification.

As shown in FIG. 8, in a connector 10B according to the second modification, three electric wire insertion holes 21 through which the electric wires 1 are inserted are formed in the housing 20 having a round shape in a front view. The electric wire insertion holes 21 are disposed at equal intervals in a circumferential direction. In the housing 20, the holding grooves 32 are formed between the electric wire insertion holes 21 on an end surface of the fitting portion 23. The holding grooves 32 communicate with each other at the center of the end surface of the fitting portion 23. Further, the notch portions 33 are formed at ends of the holding grooves 32 on outer circumferential sides respectively, so that each holding groove 32 communicates with the mounting groove 31 formed over the circumferential direction on the outer circumferential surface of the fitting portion 23.

In the connector 10B according to the second modification, three band portions 42 are formed on the sealing member 40 including the round annular sealing portion 41. The band portions 42 are connected to each other at a center position of the annular sealing portion 41 and are disposed radially. When the sealing member 40 is equipped to the fitting portion 23 of the housing 20, each band portion 42 is fitted in the holding groove 32 formed between the wire insertion holes 21 and communicating with each other at the center of the end surface of the fitting portion 23.

According to the connector 10B according to the second modification, even though frictional force acts on the annular sealing portion 41 toward the rear side in the direction of fitting into the mounting hole H, turning inside out is prevented in good balance by the three band portions 42 connected at the center position of the annular sealing portion 41. Therefore, sealing performance of the annular sealing portion 41 of the sealing member 40 with the inner circumferential surface of the mounting hole H can be reliably exhibited, and permeation of water, oil, dust, or the like between the mounting hole H and the housing 20 can be reliably prevented.

The invention is not limited to the above embodiment, and may be appropriately modified, improved, or the like. In addition, the material, shape, size, number, arrangement position, and the like of each constituent element in the above-described embodiment are arbitrary and are not limited as long as the present invention can be achieved.

For example, in the above embodiment, the housing 20 has a structure including an electric wire insertion hole 21 through which a conductor containing the electric wire 1 to which the terminal fitting 2 is connected is inserted, but the housing 20 may include an accommodation portion that accommodates and holds the terminal fitting that is a conductor connected to an end portion of the electric wire 1.

Here, characteristics of the embodiment of the connector according to the present invention described above are briefly summarized and listed in the following [1] to [4] respectively.

[1] A connector comprising:

a housing (20) having a fitting portion (23) fitted into a mounting hole (H);

a conductor (electric wire 1) held by the housing (20); and a sealing member (40) mounted on the fitting portion (23) and sealing between the housing and the mounting hole (H), wherein the sealing member (40) includes:

an annular sealing portion (41) formed in an annular shape fitted into the fitting portion (23); and a band portion (42) connected to the annular sealing portion (41) at both ends and disposed along an end surface of the fitting portion (23).

[2] The connector according to [1], wherein a plurality of the conductors (electric wires 1) are held in parallel by the housing (20), and wherein the band portion (42) is disposed between the conductors (electric wires 1) on the end surface of the fitting portion (23).

[3] The connector according to [1] or [2], wherein a holding groove (32) into which the band portion (42) is fitted is formed on the end surface of the fitting portion (23).

[4] The connector according to [3], wherein a mounting groove (31) into which the annular sealing portion (41) is fitted is formed on a circumferential surface of the fitting portion (23) over a circumferential direction, and wherein a notch portion (33) holding an end portion of the band portion (42) is formed between the holding groove (32) and the mounting groove (31).

DESCRIPTION OF REFERENCE NUMERALS AND SIGNS

1: Electric wire (Conductor)
10, 10A, 10B: Connector
20: Housing
23: Fitting portion
31: Mounting groove
32: Holding groove
33: Notch portion
40: Sealing member
41: Annular sealing portion
42: Band portion
H: Mounting hole

What is claimed is:

1. A connector comprising: a housing having a fitting portion fitted into a mounting hole; a conductor held by the housing; and a sealing member mounted on the fitting portion and sealing between an outer circumference of the housing and an inner circumference of the mounting hole, wherein the sealing member includes: an annular sealing portion formed in an annular shape fitted into an outer circumference of the fitting portion; and a band portion connected to the annular sealing portion at both ends and disposed along an end surface of the fitting portion, the band portion protrudes away from the annular sealing portion in a front-rear direction.

2. The connector according to claim 1, wherein a plurality of the conductors are held in parallel by the housing, and wherein the band portion is disposed between the conductors on the end surface of the fitting portion.

3. The connector according to claim 1, wherein a holding groove into which the band portion is fitted is formed on the end surface of the fitting portion.

4. The connector according to claim 3, wherein a mounting groove into which the annular sealing portion is fitted is formed on a circumferential surface of the fitting portion over a circumferential direction, and wherein a notch portion holding an end portion of the band portion is formed between the holding groove and the mounting groove.

* * * * *